US011217917B2

(12) United States Patent
Yang et al.

(10) Patent No.: US 11,217,917 B2
(45) Date of Patent: Jan. 4, 2022

(54) ELECTRICAL CONNECTOR ASSEMBLY

(71) Applicant: LOTES CO., LTD, Keelung (TW)

(72) Inventors: Ren Fei Yang, Keelung (TW); Zhen Feng Lyu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/021,115

(22) Filed: Sep. 15, 2020

(65) Prior Publication Data

US 2021/0359436 A1 Nov. 18, 2021

(30) Foreign Application Priority Data

May 12, 2020 (CN) ..... 202010397194.9
Jun. 20, 2020 (CN) ..... 202010569648.6

(51) Int. Cl.

| | |
|---|---|
| ***H01R 12/00*** | (2006.01) |
| ***H01R 12/57*** | (2011.01) |
| ***H01R 12/71*** | (2011.01) |
| ***H01R 13/6587*** | (2011.01) |

(52) U.S. Cl.
CPC ..... *H01R 12/57* (2013.01); *H01R 12/716* (2013.01); *H01R 13/6587* (2013.01)

(58) Field of Classification Search
CPC ..... H01R 12/55; H01R 12/57; H01R 12/716; H01R 12/718; H01R 13/6586; H01R 13/6587
USPC ..... 439/59, 83
See application file for complete search history.

(56) References Cited

U.S. PATENT DOCUMENTS

2014/0301052 A1 10/2014 Chen

FOREIGN PATENT DOCUMENTS

| | | |
|---|---|---|
| CN | 201112653 Y | 9/2008 |
| CN | 208352551 U | 1/2019 |
| CN | 109962786 A | 7/2019 |
| CN | 110829071 A | 2/2020 |
| CN | 110994230 A | 4/2020 |

*Primary Examiner* — Khiem M Nguyen
(74) *Attorney, Agent, or Firm* — Locke Lord LLP; Tim Tingkang Xia, Esq.

(57) ABSTRACT

An electrical connector assembly includes a first connector. The first connector has a main body. The main body has a first end wall and a second end wall opposite to each other. Multiple first terminals are provided on the main body. The first connector is used to be mated with a circuit board. The circuit board has multiple first conductive portions, multiple second conductive portions and multiple first wires electrically connecting the first conductive portions and the second conductive portions correspondingly. The second conductive portion is correspondingly electrically connected to the first terminal. The first end wall is located closer to the first conductive portion relative to the second end wall. A top surface of the first end wall is lower than a corresponding first conductive portion adjacent to the first end wall.

15 Claims, 11 Drawing Sheets

A–A

ELECTRICAL CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN202010397194.9 filed in China on May 12, 2020, and patent application Serial No. CN202010569648.6 filed in China on Jun. 20, 2020. The disclosure of each of the above applications is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector assembly, and particularly to an electrical connector assembly with good high frequency characteristics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector assembly includes a circuit board, a first connector and a second connector. The circuit board is provided with a plurality of first conductive portions and a plurality of second conductive portions, and a plurality of wires correspondingly connect the first conductive portions and the second conductive portions. The first connector has a plurality of first terminals correspondingly electrically connected with the second conductive portions on the circuit board, and the second connector has a plurality of second terminals correspondingly electrically connected with the first conductive portions on the circuit board. The first connector has a main body. The main body has a first end wall and a second end wall provided opposite to each other, and heights of the first end wall and the second end wall are equal.

Since the heights of the first end wall and the second end wall are equal, and the top surface of the first end wall is higher than the first conductive portion adjacent to the first end wall, when the first terminals are correspondingly electrically connected to the second conductive portions, there is a need to provide a notch having a higher bottom surface at one side of the circuit board close to the first end wall to accommodate the first end wall. Further, the top surface of the first end wall is higher than the first conductive portion adjacent to the first end wall, and the bottom surface of the notch is correspondingly higher than the first conductive portion adjacent to the first end wall. Thus, the wires from the first conductive portions to the second conductive portions need to get around the notch with the higher bottom surface, which results in the wires to have more bending, thus increasing the average length of the wires, easily causing the signal loss and crosstalk, and affecting the high frequency characteristics of the electrical connector assembly.

Therefore, a heretofore unaddressed need to design a novel electrical connector exists in the art to address the aforementioned deficiencies and inadequacies.

SUMMARY

The present invention is directed to an electrical connector assembly, in which a top surface of a first end wall is lower than a first conductive portion adjacent to the first end wall, such that a bottom surface of a notch of the circuit board close to the first end wall may be correspondingly lowered, or the notch is not even required, such that the first wire has less bending, facilitating high frequency characteristics of the electrical connector assembly.

To achieve the foregoing objective, the present invention adopts the following technical solutions. An electrical connector assembly includes: a first connector, having a main body, wherein the main body has a first end wall and a second end wall opposite to each other, and a plurality of first terminals are provided on the main body; wherein the first connector is configured to be mated with a circuit board, the circuit board has a plurality of first conductive portions, a plurality of second conductive portions and a plurality of first wires electrically connecting the first conductive portions and the second conductive portions correspondingly, the second conductive portions are correspondingly electrically connected to the first terminals, the first end wall is located closer to the first conductive portions relative to the second end wall, and a top surface of the first end wall is lower than a corresponding one of the first conductive portions adjacent to the first end wall.

In certain embodiments, a metal member is fixed to the first end wall, a side of the circuit board close to the first end wall has a notch, the metal member is accommodated in the notch, and the metal member at least partially abuts an inner edge of the notch.

In certain embodiments, the metal member has a first fixing portion and a second fixing portion provided opposite to each other, and a connecting portion connecting the first fixing portion and the second fixing portion; the first fixing portion and the second fixing portion are respectively fixed to two side surfaces of the first end wall; the connecting portion is fixed to the top surface of the first end wall; the inner edge of the notch has a first surface and a second surface opposite to each other, and the first fixing portion abuts the first surface, or the second fixing portion abuts the second surface, or the first fixing portion and the second fixing portion respectively abut the first surface and the second surface.

In certain embodiments, the main body has two side walls connecting the first end wall and the second end wall and opposite to each other, the first end wall, the second end wall and the two side walls collectively define a mating slot to be mated with the circuit board, a top surface of the second end wall is higher than the top surface of the first end wall, and in a mating direction for the mating slot to mate with the circuit board, the metal member at least partially abuts the inner edge of the notch.

In certain embodiments, the first connector has the first terminals respectively provided on the two side walls and exposed to the mating slot, and the first terminals comprise a plurality of first high speed signal terminals; and the circuit board has the second conductive portions respectively provided on two opposite surfaces of the circuit board, the first high speed signal terminals are correspondingly electrically connected to the second conductive portions, and the second end wall is located closer to the first high speed signal terminals relative to the first end wall.

In certain embodiments, a metal member is fixed to the second end wall, a side of the circuit board close to the second end wall has a notch, the metal member is accommodated in the notch, and the metal member at least partially abuts an inner edge of the notch; the main body has a mating slot to be mated with the circuit board, the circuit board has a mating edge, the mating slot has a mating bottom surface opposite to the mating edge, the top surface of the first end wall is defined as a first top surface, and the first top surface is flush with the mating bottom surface; and gaps exists between the mating edge and the mating bottom surface and between the first top surface and the mating bottom surface, or the mating edge simultaneously abuts the first top surface and the mating bottom surface.

In certain embodiments, the metal member has a first fixing portion and a second fixing portion provided opposite to each other, and a connecting portion connecting the first fixing portion and the second fixing portion; the first fixing portion and the second fixing portion are respectively fixed to two side surfaces of the second end wall; a top surface of the second end wall is defined as a second top surface, and the connecting portion is fixed to the second top surface; and a side of the notch away from the first end wall has a position limiting portion, and a side surface of the position limiting portion abuts the first fixing portion.

In certain embodiments, a metal member is fixed to the second end wall, a side of the circuit board close to the second end wall has a notch, the metal member is accommodated in the notch, and the metal member at least partially abuts an inner edge of the notch; the main body has a mating slot to be mated with the circuit board, the circuit board has a mating edge, the mating slot has a mating bottom surface opposite to the mating edge, the top surface of the first end wall is defined as a first top surface, the mating edge has a first portion and a second portion, the first portion is opposite to the first top surface, the second portion is opposite to the mating bottom surface, the first portion and the second portion are co-planar, and the mating edge is a continuous flat surface; and the first top surface is higher than the mating bottom surface, and the mating edge only abuts the first top surface; or the first top surface is lower than the mating bottom surface, and the mating edge only abuts the mating bottom surface.

In certain embodiments, the circuit board further has a plurality of third conductive portions and a plurality of fourth conductive portions, the third conductive portions and the first conductive portions are arranged on a same first straight line, the fourth conductive portions and the second conductive portions are arranged on a same second straight line, and the first straight line and the second straight line are not collinear; the first connector has the first terminals, comprising a plurality of first high speed signal terminals and a plurality of first low speed signal terminals, the first high speed signal terminals are correspondingly electrically connected to the second conductive portions, and the first low speed signal terminals are correspondingly electrically connected to the fourth conductive portions; and a second connector is provided with a plurality of second terminals, comprising a plurality of second high speed signal terminals and a plurality of second low speed signal terminals, the second high speed signal terminals are correspondingly electrically connected to the first conductive portions, and the second low speed signal terminals are correspondingly electrically connected to the third conductive portions.

In certain embodiments, the circuit board has a plurality of wires provided in at least four layers, the wires comprise the first wires symmetrically located in two opposite outermost layers of the at least four layers of the circuit board and a plurality of second wires symmetrically located in two central layers of the at least four layers of the circuit board, the first wires correspondingly connect the first conductive portions and the second conductive portions, and the fourth conductive portions correspondingly electrically connected to the first low speed signal terminals and the third conductive portions correspondingly electrically connected to the second low speed signal terminals are electrically connected by the second wires.

In certain embodiments, the third conductive portions are located below the first conductive portions, and when the second conductive portions are correspondingly electrically connected to the first terminals, a bottom surface of the main body is higher than or flush with at least one of the third conductive portions.

In certain embodiments, a second connector is provided with a plurality of second terminals, the first conductive portions are correspondingly electrically connected to the second terminals, the second connector has a metal shell, the metal shell covers the first end wall, the metal shell has two mounting portions respectively located at two opposite sides of the main body and flush with a bottom surface of the main body, and the two mounting portions and the main body are mounted on a same substrate.

In certain embodiments, an arranging direction of the first conductive portions and an arranging direction of the second conductive portions are perpendicular to each other; the circuit board has the first wires, each of the first wires has a horizontal section and an oblique section connected to each other, the horizontal section and a corresponding one of the first conductive portions are located on a same straight line, and the horizontal section is parallel to the arranging direction of the second conductive portions; and the oblique section is a straight line structure, the oblique sections of the first wires form a plurality of straight lines parallel to one another, each of the oblique sections of the first wires has a first end portion and a second end portion, the second end portion is located closer to a corresponding one of the second conductive portions relative to the first end portion, the first end portion is connected to the horizontal section, the second end portion and the corresponding one of the first conductive portions are located on a same straight line, and the second end portion is located above the corresponding one of the second conductive portions.

In certain embodiments, the circuit board further has a plurality of third conductive portions and a plurality of fourth conductive portions, the fourth conductive portions are located closer to the third conductive portions relative to the second conductive portions; the first connector has the first terminals, comprising a plurality of first power terminals, and the first power terminals are correspondingly electrically connected to the fourth conductive portions; a second connector is provided with a plurality of second terminals, comprising a plurality of second power terminals, and the second power terminals are correspondingly electrically connected to the second conductive portions; and the fourth conductive portions correspondingly electrically connected to the first power terminals and the second conductive portions correspondingly electrically connected to the second power terminals are electrically connected to each other by at least one conductive plate.

In certain embodiments, the circuit board comprises a first circuit board, a second circuit board and a connecting member located between the first circuit board and the second circuit board, the connecting member comprises two insulators and a shielding member located between the two insulators, the shielding member is provided with at least two abutting sheets, and the at least two abutting sheets respectively pass through the insulators to abut a grounding wire on the first circuit board and a grounding wire on the second circuit board.

Compared with the related art, the electrical connector assembly according to certain embodiments of the present invention has the following beneficial effects.

By having the top surface of the first end wall to be lower than the corresponding first conductive portion adjacent to the first end wall, a bottom surface of a notch of the circuit board close to the first end wall may be correspondingly lowered to be located lower than the corresponding first conductive portion adjacent to the first end wall. Alternatively, the notch is not even required, such that the first wires have less bending from the first conductive portions to the second conductive portions, thus reducing the overall length of each of the first wires, reducing the signal loss and improving the crosstalk, and facilitating high frequency characteristics of the electrical connector assembly.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
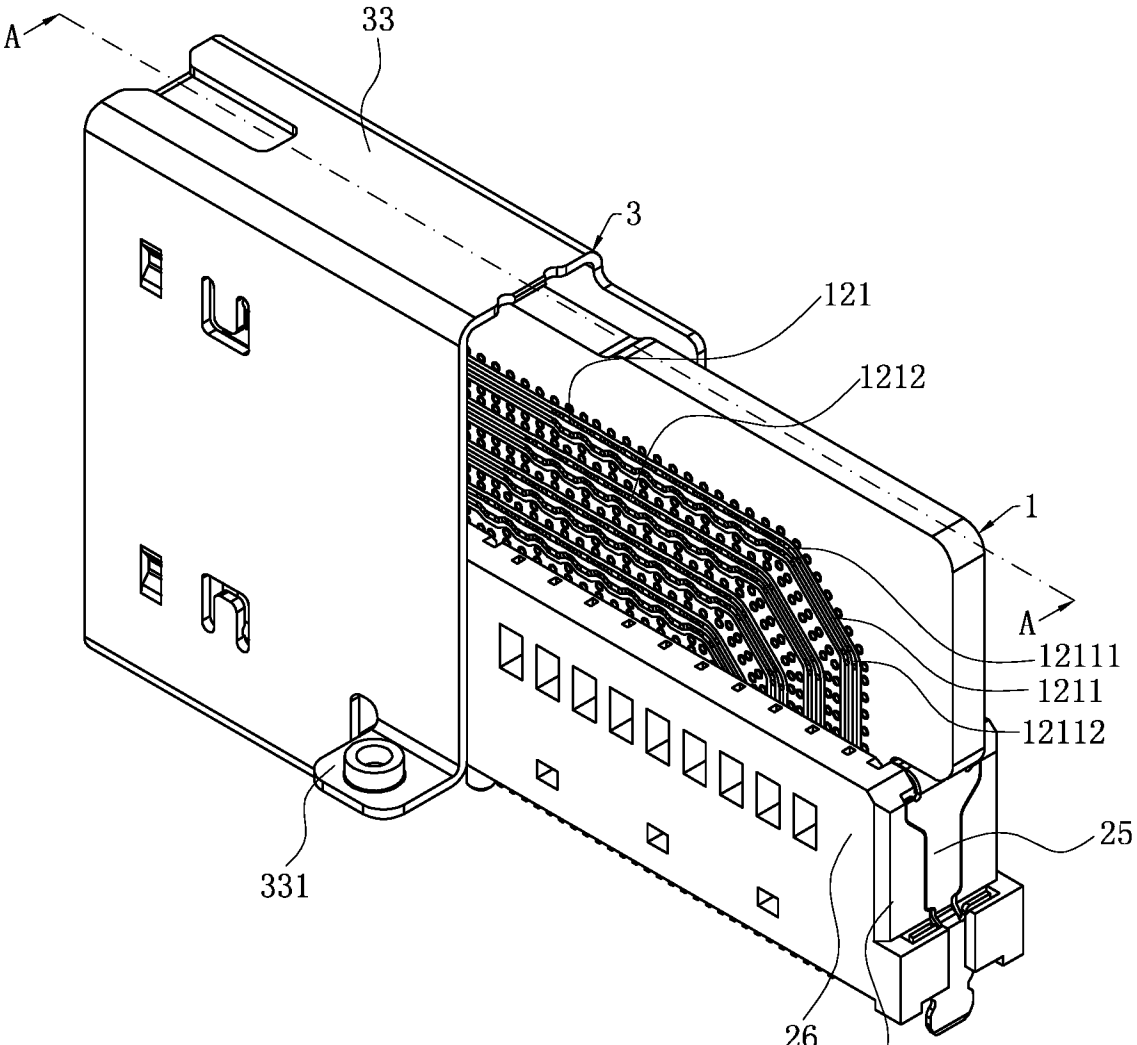
FIG. 1 is a perspective assembled view of an electrical connector assembly according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector assembly.

Figure 2:
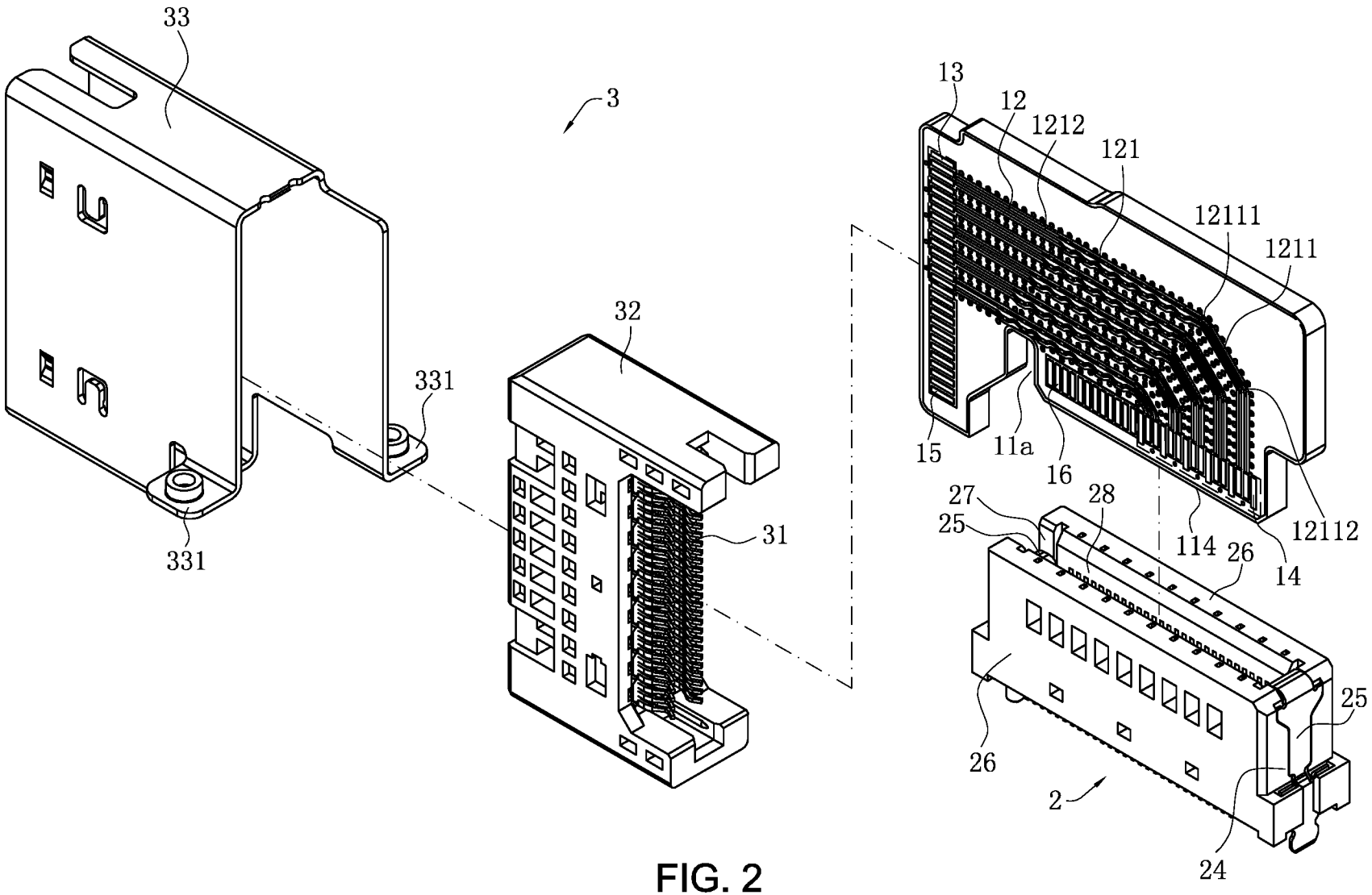
FIG. 2 is a perspective exploded view of the electrical connector assembly according to the first embodiment of the present invention.

FIG. 1 and FIG. 2 show an electrical connector assembly 100 according to a first embodiment of the present invention. The electrical connector assembly 100 includes a circuit board 1, a first connector 2 and a second connector 3. The first connector 2 and the second connector 3 are electrically connected by the circuit board 1.

Figure 3:
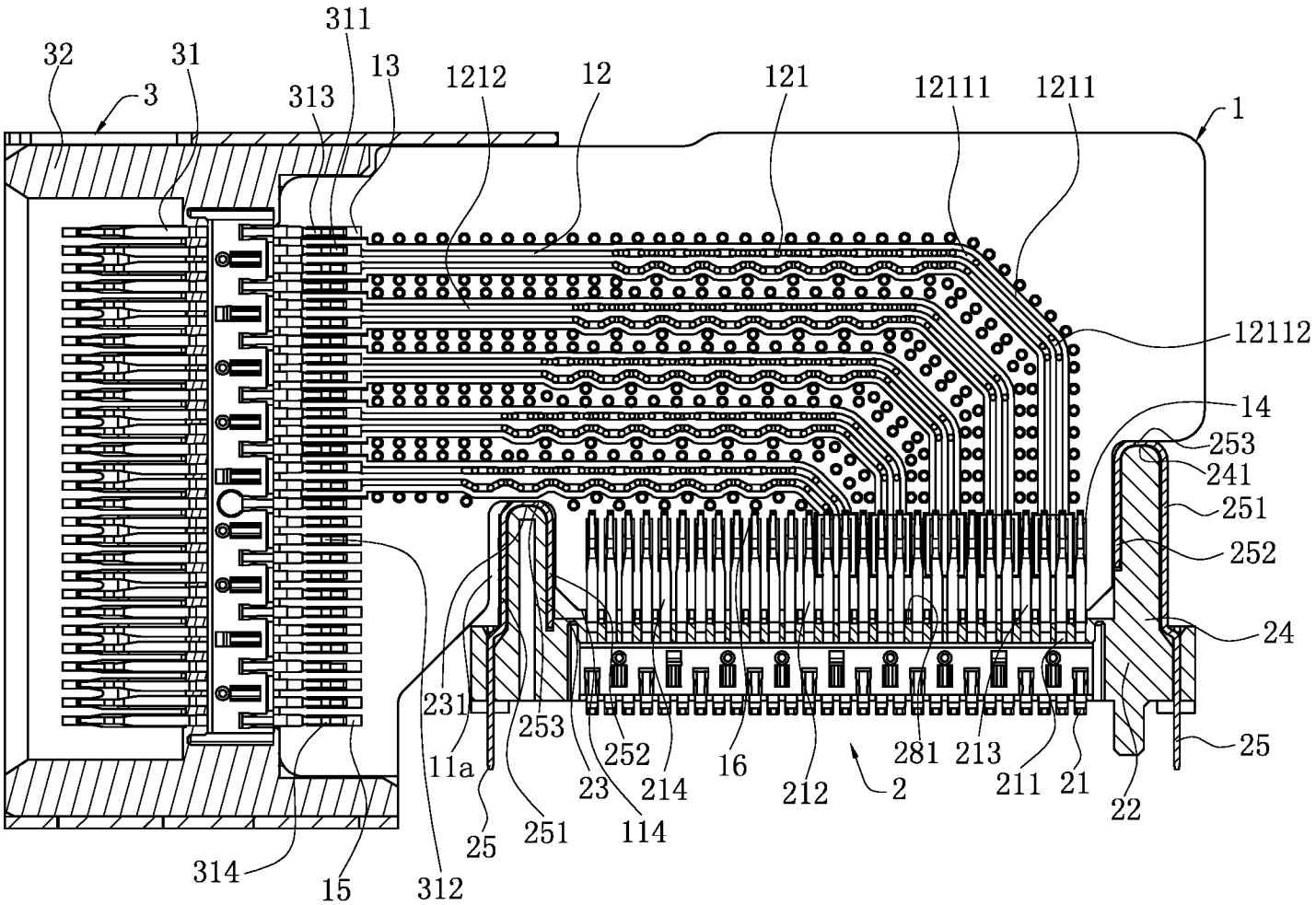
FIG. 3 is a schematic view of FIG. 1 by removing the metal shell and sectioning the first main body and the second main body along line A-A.

As shown in FIG. 1 to FIG. 3, the first connector 2 has a first main body 22. The first main body 22 has a first end wall 23 and a second end wall 24 opposite to each other, and two side walls 26 connecting the first end wall 23 and the second end wall 24. A top surface of the first end wall 23 is defined as a first top surface 231, and a top surface of the second end wall 24 is defined as a second top surface 241. The first end wall 23, the second end wall 24 and the two side walls 26 collectively define a mating slot 28 to be mated with the circuit board 1. The circuit board 1 has a mating edge 114. The mating slot 28 has a mating bottom surface 281 opposite to the mating edge 114. The mating edge 114 has a first portion 1141 and a second portion 1142 (referring to FIG. 5). The first portion 1141 and the first top surface 231 are opposite to each other, and the second portion 1142 and the mating bottom surface 281 are opposite to each other. A plurality of first terminals 21 are respectively provided on the two side walls 26 of the first main body 22, and are all exposed to the mating slot 28. The first terminals 21 include a plurality of first high speed signal terminals 211, a plurality of first low speed signal terminals 212, a plurality of first ground terminals 213 and a plurality of first power terminals 214. One of the first ground terminals 213 and a pair of the first high speed signal terminals 211 are alternatively arranged at intervals. The first ground terminals 213 may effectively reduce the crosstalk between two adjacent pairs of the first high speed signal terminals 211, thus reducing the loss of high frequency signals.

As shown in FIG. 2 and FIG. 3, the second top surface 241 of the second end wall 24 is higher than the first top surface 231 of the first end wall 23, and the top surfaces of the two side walls 26 are flush with the second top surface 241 of the second end wall 24. An opening 27 is formed by the first top surface 231 of the first end wall 23 and the two side walls 26, and the opening 27 is in communication with the mating slot 28. The second end wall 24 is located closer to the first high speed signal terminals 211 than the first end wall 23. The second end wall 24, which is higher, provides better shielding functions to the first high speed signal terminals 211, and the opening 27 above the first end wall 23 has less effect to the first high speed signal terminals 211, thus preventing from interference of the outer environment. In other embodiments, the second top surface 241 of the second end wall 24 may be flush with the first top surface 231 of the first end wall 23, and the top surfaces of the two side walls 26 are higher than the second top surface 241 of the second end wall 24. The two side walls 26, which are higher, may provide better shielding functions to the first high speed signal terminals 211 provided on the two side walls 26.

As shown in FIG. 1 to FIG. 3, a metal member 25 is fixed on the first end wall 23. The metal member 25 has a first fixing portion 251 and a second fixing portion 252 provided opposite to each other, and a connecting portion 253 connecting the first fixing portion 251 and the second fixing portion 252. The first fixing portion 251 and the second fixing portion 252 are respectively fixed to two side surfaces of the first end wall 23, and the connecting portion 253 is fixed to the first top surface 231. In other embodiments, the metal member 25 may be sheet-shaped or in other shapes. Further, another metal member 25 having the identical structures is fixed to the second end wall 24, in which the first fixing portion 251 and the second fixing portion 252 are respectively fixed to two side surfaces of the second end wall 24, and the connecting portion 253 is fixed to the second top surface 241. Both the first end wall 23 and the second end wall 24 are provided and fixed with the metal members 25, which may prevent the circuit board 1 or other components from scratching or damaging the first end wall 23 and the second end wall 24, and strengthen the first end wall 23 and the second end wall 24. In other embodiments, there may be no metal member 25 fixed to the first end wall 23 and the second end wall 24.

Figure 5:
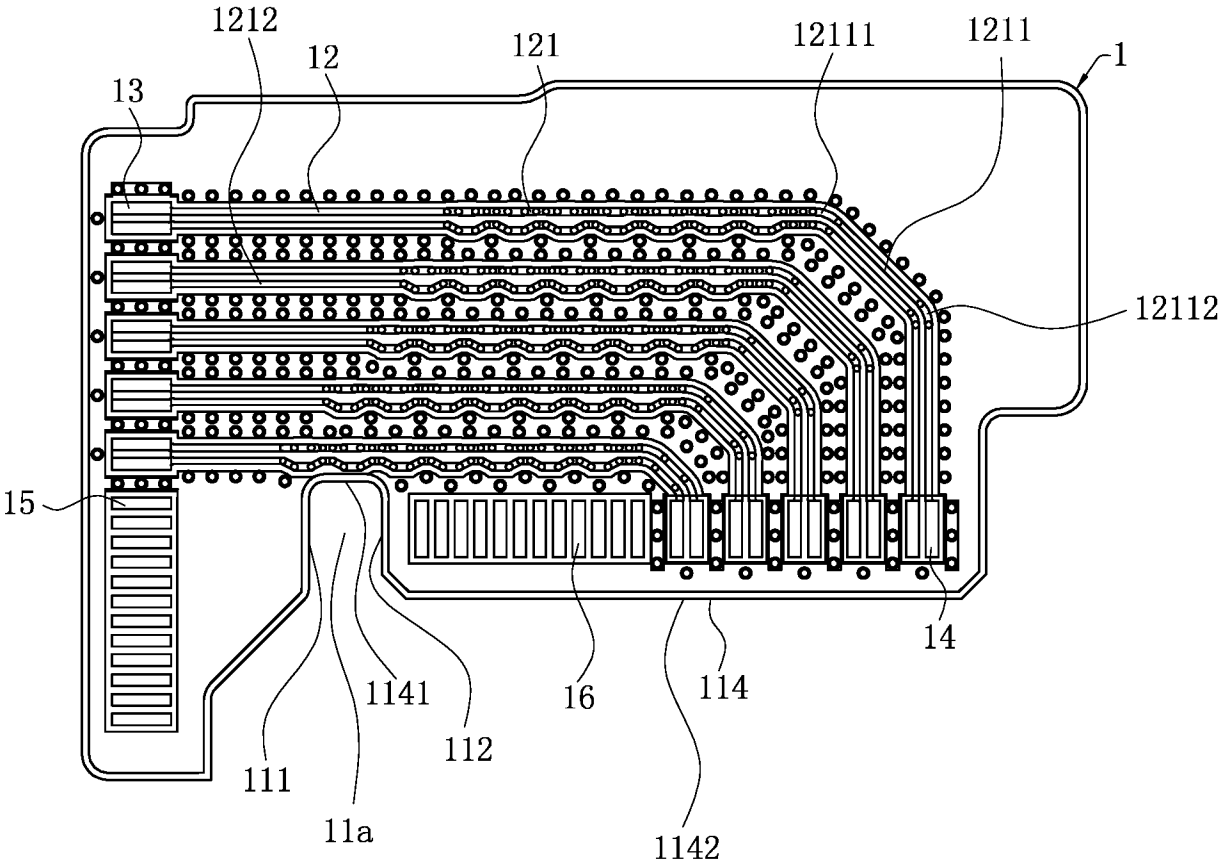
FIG. 5 is a schematic view of an outermost layer of the circuit board of the electrical connector assembly according to the first embodiment of the present invention.
Figure 6:
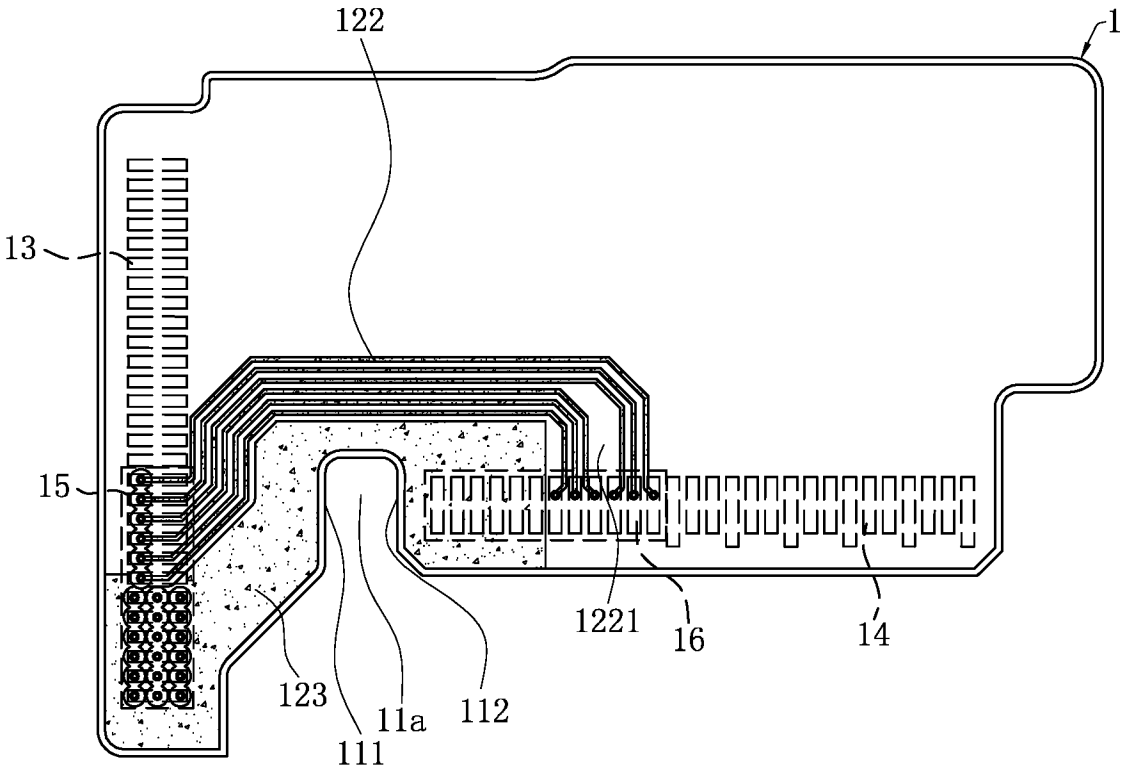
FIG. 6 is a schematic view of a central layer of the circuit board of the electrical connector assembly according to the first embodiment of the present invention.

As shown in FIG. 3, FIG. 5 and FIG. 6, the circuit board 1 has a plurality of first conductive portions 13, a plurality of second conductive portions 14, a plurality of third conductive portions 15, a plurality of fourth conductive portions 16, and a plurality of wires 12. The wires 12 include a plurality of first wires 121, a plurality of second wires 122 and two conductive plates 123. The conductive plates 123 may be copper plates or other metal plates with good electrical conductivity. Both the first wires 121 and the second wires 122 include signal wires (not labeled, same below) and grounding wires (not labeled, same below). The signal wires and the grounding wires are alternately arranged. The grounding wires may reduce the crosstalk between the signal wires, thus reducing the loss of signals in the transmission process. The first wires 121 correspondingly electrically connect the first conductive portions 13 and the second conductive portions 14, and a part of the third conductive portions 15 and a part of the fourth conductive portions 16 are correspondingly electrically connected by the second wires 122. One of the first terminals 21 is correspondingly electrically connected to one of the second conductive portions 14 or one of the fourth conductive portions 16. The first high speed signal terminals 211 and the first ground terminals 213 are correspondingly electrically connected to the second conductive portions 14, and the first low speed signal terminals 212 and the first power terminals 214 are correspondingly electrically connected to the fourth conductive portions 16.

As shown in FIG. 3, FIG. 5 and FIG. 6, the circuit board 1 has four layers for the arrangement of the wires 12. In other embodiments, the circuit board 1 may have more layers for the arrangement of the wires 12. The first wires 121 are symmetrically located in two opposite outermost layers of the circuit board 1, and the second wires 122 and the two conductive plates 123 are symmetrically located in two central layers of the circuit board 1. The first conductive portions 13, the second conductive portions 14, the third conductive portions 15 and the fourth conductive portions 16 are all symmetrically located in the two opposite outermost layers of the circuit board 1. The second wires 122 in the two central layers of the circuit board 1 electrically connect a part of the third conductive portions 15 and a part of the fourth conductive portions 16 located in the two opposite outermost layers of the circuit board 1. An electrical transition portion (not shown, same below) is provided between each second wire 122 and a corresponding one of the third conductive portions 15 or a corresponding one of the fourth conductive portions 16, and an electrical transition portion is provided between each conductive plate 123 and a corresponding one of the third conductive portions 15 or a corresponding one of the fourth conductive portions 16.

As shown in FIG. 2, FIG. 3 and FIG. 5, a side of the circuit board 1 close to the first end wall 23 has a notch 11*a*. The metal member 25 fixed to the first end wall 23 is accommodated in the notch 11*a*, and the metal member 25 abuts an inner edge of the notch 11*a*. The inner edge of the notch 11*a* has a first surface 111 and a second surface 112 opposite to each other. The first fixing portion 251 abuts the first surface 111. Alternatively, the second fixing portion 252 abuts the second surface 122. Alternatively, the first fixing portion 251 and the second fixing portion 252 respectively abut the first surface 111 and the second surface 112. The metal member 25 fixed to the first end wall 23 abuts the first surface 111 or the second surface 112, or simultaneously abuts the first surface 111 and the second surface 112. The structure between the first end wall 23 and the notch 11*a* is stable, ensuring stable electrical connections between the first terminals 21 and the second conductive portions 14 and between the first terminals 21 and the fourth conductive portions 16. Further, in a mating direction for the mating slot 28 to mate with the circuit board 1, the connecting portion 253 of the metal member 25 fixed to the first end wall 23 abuts the inner edge of the notch 11*a*, thus limiting the circuit board 1 from being mated excessively with the first main body 22, and ensuring the first terminals 21 to be properly electrically connected to the second conductive portions 14 and the fourth conductive portions 16. In other embodiments, the connecting portion 253 of the metal member 25 fixed to the first end wall 23 may be configured not to abut the inner edge of the notch 11*a*.

As shown in FIG. 2, FIG. 3 and FIG. 5, since the first end wall 23 is located closer to the first conductive portion 13 relative to the second end wall 24, and the first top surface 231 of the first end wall 23 is lower than the first conductive portion 13 adjacent to the first end wall 23, a bottom surface of the notch 11*a* may be correspondingly lowered to be located lower than a corresponding first conductive portion 13 adjacent to the first end wall 23, such that the first wires 121 have less bending from the first conductive portions 13 to the second conductive portions 14, thus reducing the overall length of each of the first wires 121, reducing the signal loss and improving the crosstalk, and facilitating high frequency characteristics of the electrical connector assembly 100.

As shown in FIG. 1 to FIG. 3, the second connector 3 has a second main body 32 and a plurality of second terminals 31 provided on the second main body 32. The second terminals 31 are correspondingly electrically connected to the first conductive portions 13 and the third conductive portions 15. Specifically, the second terminals 31 are correspondingly soldered to the first conductive portions 13 and the third conductive portions 15. The second terminals 31 include a plurality of second high speed signal terminals 311, a plurality of second low speed signal terminals 312, a plurality of second ground terminals 313 and a plurality of second power terminals 314. One of the second ground terminals 313 and a pair of the second high speed signal terminals 311 are alternatively arranged at intervals. The second ground terminals 313 may effectively reduce the crosstalk between two adjacent pairs of the second high speed signal terminals 311, thus reducing the loss of high frequency signals. One of the second terminals 31 is correspondingly electrically connected to one of the first conductive portions 13 or one of the third conductive portions 15. The second high speed signal terminals 311 and the second ground terminals 313 are correspondingly electrically connected to the first conductive portions 13, and the second low speed signal terminals 312 and the second power terminals 314 are correspondingly electrically connected to the third conductive portions 15.

As shown in FIG. 3, FIG. 5 and FIG. 6, the first wires 121 electrically connecting the first conductive portions 13 and the second conductive portions 14 are symmetrically located in the two opposite outermost layers of the circuit board 1, the fourth conductive portions 16 correspondingly electrically connected to the first low speed signal terminals 212 and the third conductive portions 15 correspondingly electrically connected to the second low speed signal terminals 312 are electrically connected by the second wires 122 symmetrically located in the two central layers of the circuit board 1, and the fourth conductive portions 16 correspondingly electrically connected to the first power terminals 214 and the third conductive portions 15 correspondingly electrically connected to the second power terminals 314 are electrically connected by the two conductive plates 123 symmetrically located in the two central layers of the circuit board 1. The fourth conductive portions 16 are located closer to the third conductive portions 15 relative to the second conductive portions 14. Thus, the loss of current from the third conductive portions 15 to the fourth conductive portions 16 is less. Further, since larger currents are transmitted between the second power terminals 314 and the first power terminals 214, the general wires 12 may easily burn out when supporting the larger currents. Thus, stable transmission of the larger currents may be facilitated by the two conductive plates 123 which are wider.

As shown in FIG. 3, FIG. 5 and FIG. 6, the first wires 121 mainly transmitting high frequency signals are located in two opposite outermost layers of the circuit board 1. The first wires 121 has larger areas exposed in the air, and air has a smaller loss factor and a smaller dissipation factor (DF) value, which facilitates reducing the loss of the high frequency signals in the transmission process. The first wires 121 mainly transmitting high frequency signals are located in the two outermost layers of the circuit board 1 with a longer interval therebetween, and two central layers provided with the second wires 122 are provided between the two outermost layers provided with the first wires 121, thus reducing the signal crosstalk between the two outermost layers provided with the first wires 121, and facilitating enhancing the high frequency characteristics of the electrical connector assembly 100. The first wires 121 and the second wires 122 are provided in different layers of the circuit board 1, such that the wire width of each first wire 121 may be provided larger, facilitating fast and stable transmission of the high frequency signals. Further, compared to the case where the first wires 121 and the second wires 122 are provided in the same layer, by providing the first wires 121 and the second wires 122 in different layers, the area of each layer of the circuit board 1 may be provided smaller, facilitating reducing the space occupied by the circuit board 1. In other embodiments, some of the first wires 121 may be provided in any two symmetrical layers in the middle of the circuit board 1, and the second wires 122 may be provided in the two outermost layers of the circuit board 1, as long as the arrangement of the first wires 121 and the second wires 122 facilitates enhancing the high frequency characteristics of the electrical connector assembly 100.

As shown in FIG. 6, six second wires 122 electrically connect six of the third conductive portions 15 and six of the fourth conductive portions 16. At the side close to the six fourth conductive portions 16, the six second wires 122 are divided into two groups of three second wires 122. A separation 1221 is provided between the two groups of three second wires 122, enhancing the shielding effect between the two groups of the second wires 122, thus reducing the interference between the two groups of the second wires 122, and ensuring the stability of the transmission signals of the two groups of the second wires 122 at the side of the fourth conductive portions 16. In other embodiments, the quantities of the second wires 122, the third conductive portions 15 and the fourth conductive portions 16 may all be greater than six, as long as the second wires 122, the third conductive portions 15 and the fourth conductive portions 16 are all one-to-one corresponding to one another.

Figure 4:
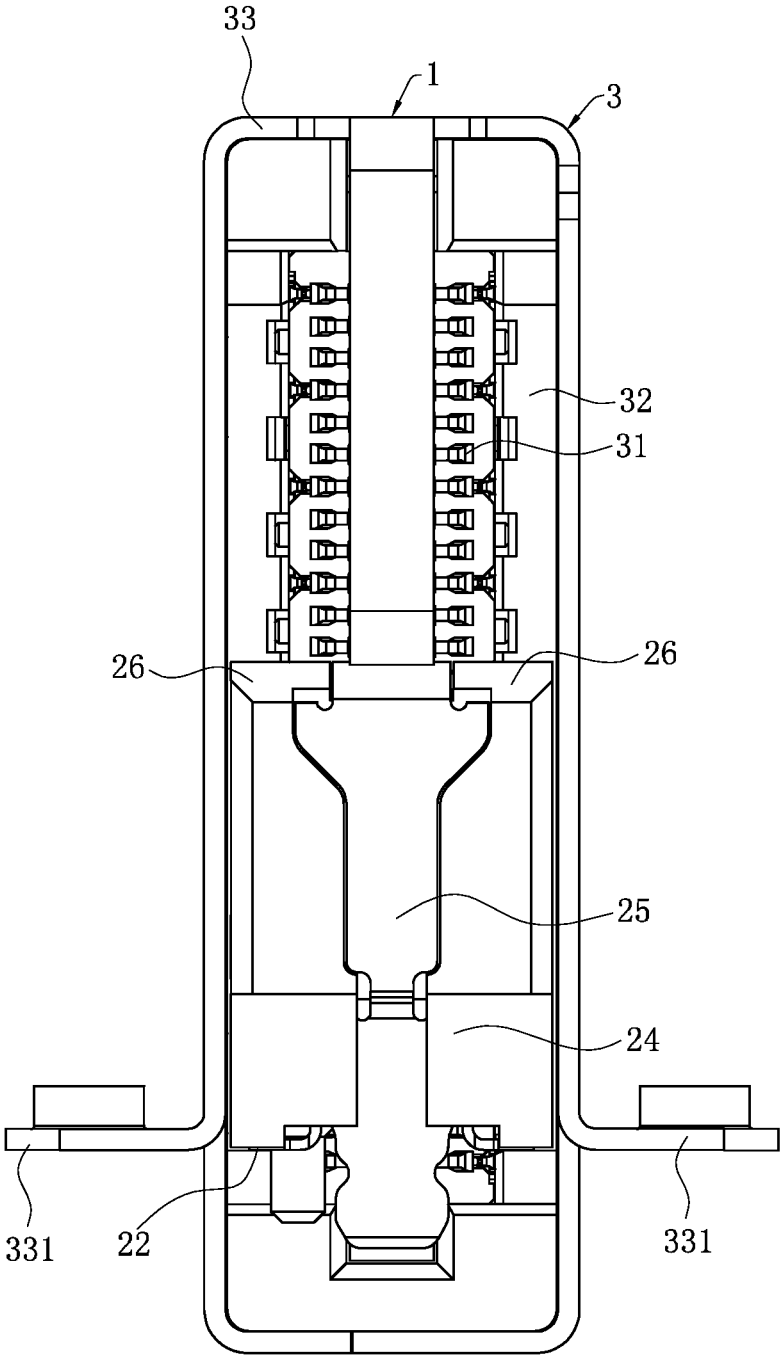
FIG. 4 is a side view of the electrical connector assembly according to the first embodiment of the present invention.

As shown in FIG. 1 and FIG. 4, the second connector 3 further has a metal shell 33, and a portion of the circuit board 1 close to the second connector 3 and a portion of the first connector 2 close to the second connector 3 are both covered by the metal shell 33. Although the opening 27 is provided above the first end wall 23, the metal shell 33 covers the first end wall 23, such that the side of the first end wall 23 also has better shielding functions, preventing from interference of the outer environment, and allowing better overall shielding characteristics for the first connector 2. The metal shell 33 has two fixing portions 331, and the two fixing portions 331 are located at two opposite sides of the first main body 22 and are both flush with the bottom surface of the first main body 22. The two fixing portions 331 and the first main body 22 are all mounted on a same substrate (not shown, same below). The metal shell 33 is mounted on the same substrate by the two fixing portions 33 as the first main body 22, ensuring the stable structure of the electrical connector assembly 100, and the stable electrical connection between the second connector 3 and the circuit board 1 and between the circuit board 1 and the first connector 2.

The manufacturing process of the electrical connector assembly 100 is substantially as follows. Firstly, the first connector 2 is mounted on the substrate, and then the second connector 3 is soldered and fixed to the circuit board 1. Then, the circuit board 1 fixed with the second connector 3 is mated with the first connector 2, and the metal shell 33 of the second connector 3 is mounted on the substrate. Since the two fixing portions 331 are located close to the first end wall 23, by mounting the metal shell 33 to the substrate, the metal shell 33 provides supporting functions to the side of the circuit board 1 being fixed and connected thereto close to the first end wall 23, such that the circuit board 1 is not mated excessively with the first end wall 23.

As shown in FIG. 2, FIG. 3 and FIG. 5, the third conductive portions 15 are located below the first conductive portions 13. When the second conductive portions 14 are correspondingly electrically connected to the first terminals 21, the bottom surface of the first main body 22 is higher than the lowest one of the third conductive portions 15. The third conductive portions 15 are located below the first conductive portions 13, and the first top surface 231 of the first end wall 23 is also lower than the first conductive portion 13 adjacent to the first end wall 23. Thus, the third conductive portions 15 and the first end wall 23 are located at the same side of the first conductive portions 13. Further, the bottom surface of the first main body 22 is higher than the lowest one of the third conductive portions 15, thus reducing the overall volume of the electrical connector assembly 100, and saving space. In other embodiments, on the premise that the first top surface 231 of the first end wall 23 is lower than the first conductive portion 13 adjacent to the first end wall 23, the bottom surface of the first main body 22 may be higher than any other one of the third conductive portions 15, or the bottom surface of the first main body 22 may be flush with any one of the third conductive portions 15.

As shown in FIG. 2, FIG. 3 and FIG. 5, an arranging direction of the first conductive portions 13 and an arranging direction of the second conductive portions 14 are perpendicular to each other. Each first wire 121 has a horizontal section 1212 and an oblique section 1211 connected to each other. The oblique sections 1211 of the first wires 121 cause the lengths of the first wires 121 to be different. Further, the two first wires 121 electrically connecting the first conductive portions 13 electrically connected to a pair of the second high speed signal terminals 311 and the second conductive portions 14 electrically connected to the first high speed signal terminals 211 are used to transmit differential signals. To ensure the consistency of the differential signals transmitted by the two first wires 121, and to overcome the deficiency of the phase difference between the two first wires 121 caused by the oblique sections 1211, the shorter first wire 121 of the two first wires 121 are slightly bended such that the lengths of the two first wires 121 are equal, thus enhancing the quality of the differential signals.

As shown in FIG. 2, FIG. 3 and FIG. 5, the horizontal section 1212 and a corresponding one of the first conductive portions 13 are located on a same straight line, and the horizontal section 1212 is parallel to the arranging direction of the second conductive portions 14. The second conductive portions 14 are located farther away from the first conductive portions 13 relative to the fourth conductive portions 16, such that the horizontal section 1212 has sufficient space for adjustment of proper impedance. Further, the horizontal sections 1212 of the first wires 121 have less bending, such that impedance of each horizontal section 1212 is stable, with less signal reflection and radiation energy, interference between the horizontal sections 1212 of the first wires 121 is smaller, facilitating stable and fast transmission of the high frequency signals. The oblique section 1211 is a straight line structure, and the oblique sections 1211 of the first wires 121 form a plurality of straight lines parallel to one another. Each of the oblique sections 1211 of the first wires 121 has a first end portion 12111 and a second end portion 12112, and the second end portion 12112 is located closer to a corresponding one of the second conductive portions 14 relative to the first end portion 12111. The first end portion 12111 is connected to the horizontal section 1212. The second end portion 12112 and the corresponding one of the first conductive portions 13 are located on a same straight line, and the second end portion 12112 is located above the corresponding one of the first conductive portions 14. From the first end portion 12111 to the second end portion 12112, a straight line between the two points is the shortest path. Thus, the oblique section 1211 shortens the length of the corresponding first wire 121, and the average length of the first wires 121 is reduced, thus reducing the signal loss and crosstalk interference, and facilitating high frequency characteristics of the electrical connector assembly 100.

Figure 7:
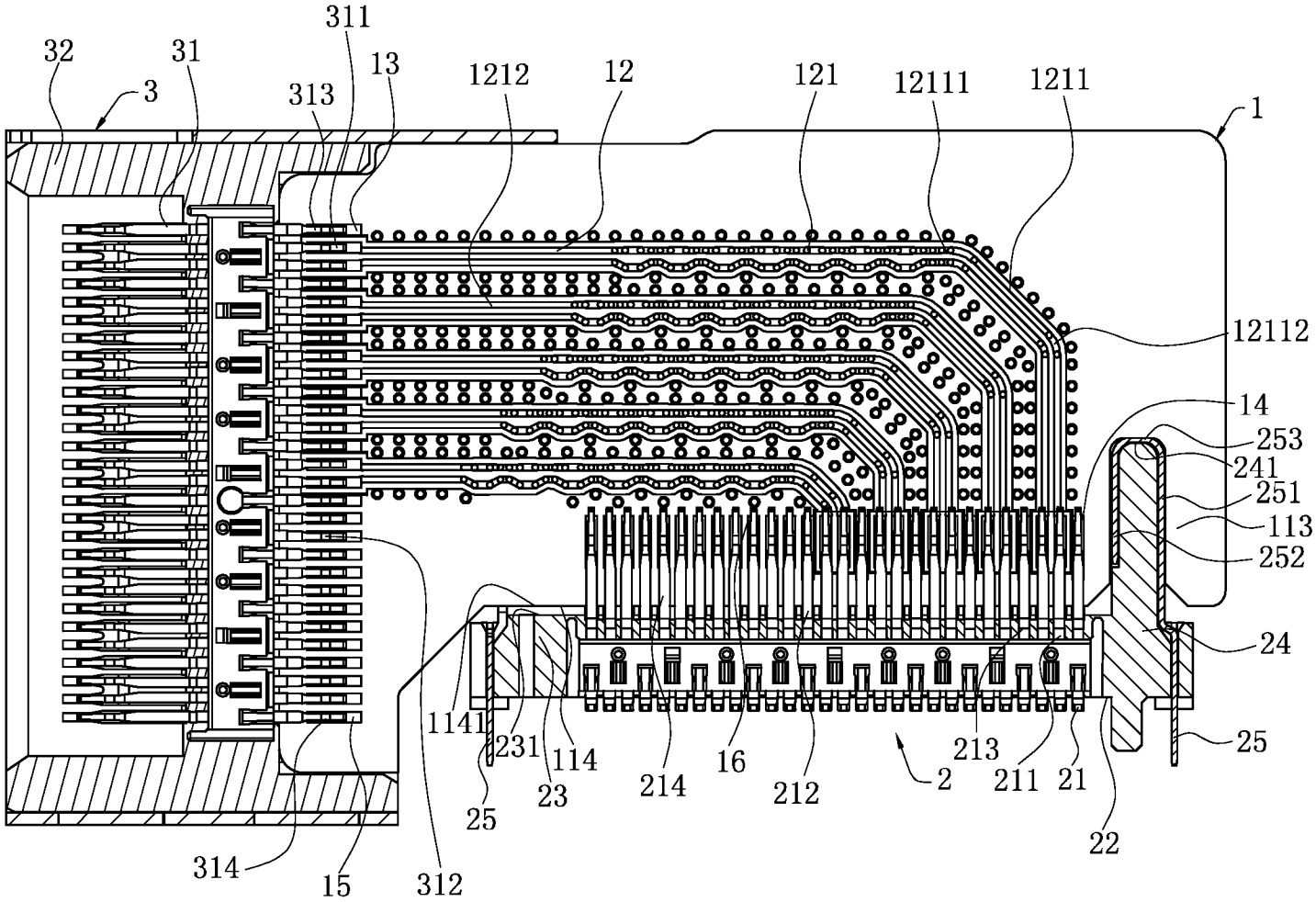
FIG. 7 is a schematic view of an electrical connector assembly according to a second embodiment of the present invention by removing the metal shell and sectioning the first main body and the second main body.
Figure 8:
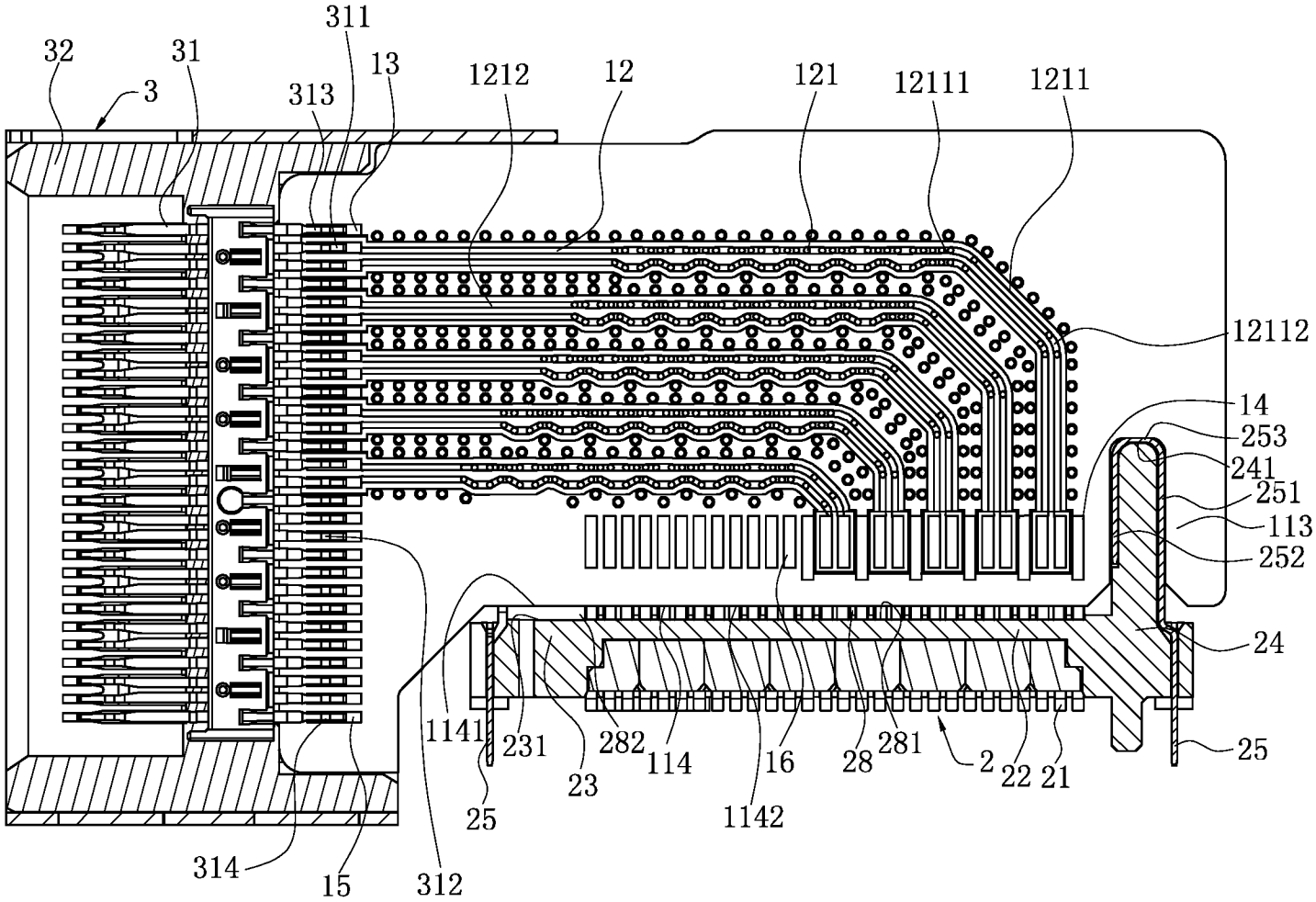
FIG. 8 is a schematic view of FIG. 7 by removing a row of first terminals when gaps exist between the mating edge and the top surface of the first end wall and between the bottom surface of the mating slot and the top surface of the first end wall.
Figure 9:
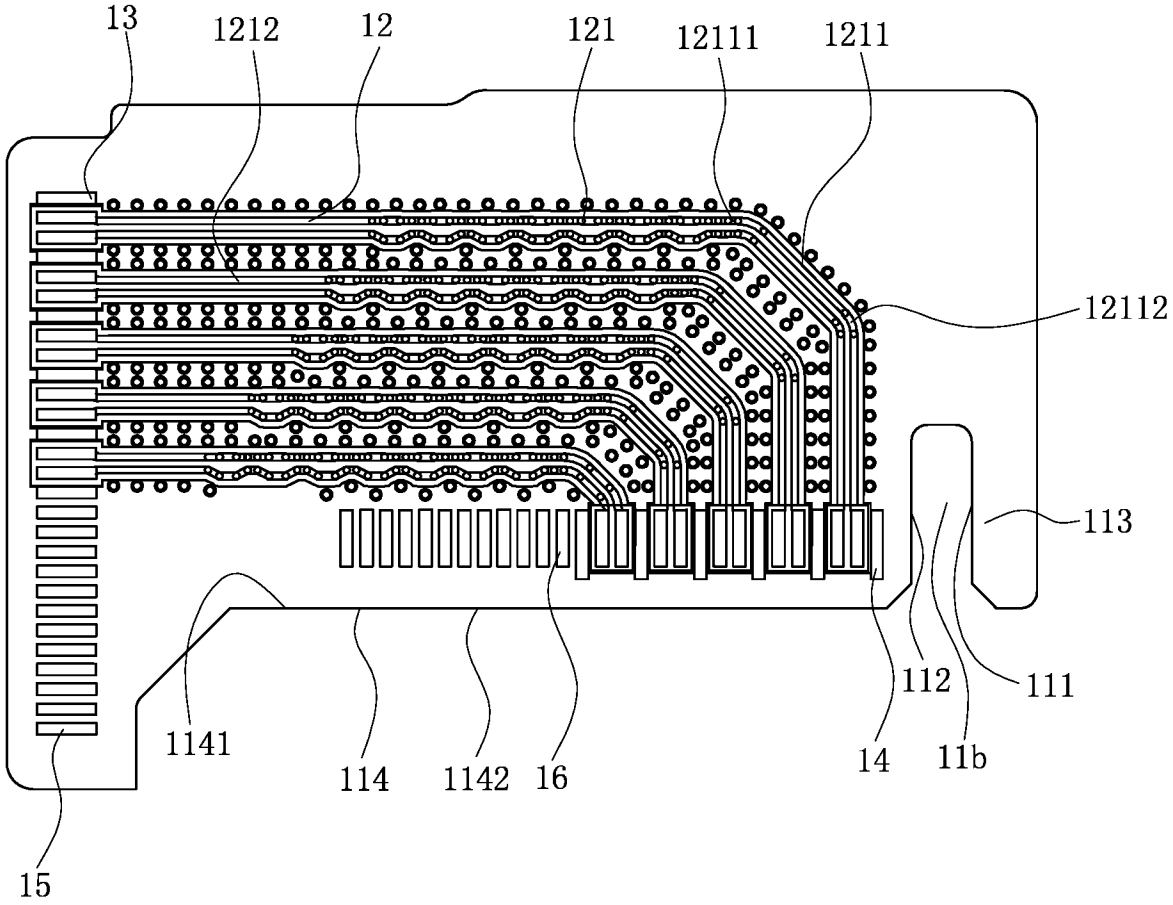
FIG. 9 is a schematic view of an outermost layer of the circuit board in the electrical connector assembly according to the second embodiment of the present invention.

FIG. 7, FIG. 8 and FIG. 9 show an electrical connector assembly 100 according to a second embodiment of the present invention, which is different from the first embodiment in that: to enhance the stability of the first main body 22 and the circuit board 1, a side of the circuit board 1 close to the second end wall 24 has another notch 11*b*. The metal member 25 fixed to the second end wall 24 is accommodated in the notch 11*b*, and the metal member 25 abuts an inner edge of the notch 11*b*. A side of the notch 11*b* away from the first end wall 23 has a position limiting portion 113, and a side surface of the position limiting portion 113 abuts the first fixing portion 251. The structure between the second end wall 24 and the circuit board 1 is stable, ensuring stable electrical connections between the first terminals 21 and the second conductive portions 14 and between the first terminals 21 and the fourth conductive portions 16.

As shown in FIG. 7 and FIG. 8, in a mating direction for the mating slot 28 to mate with the circuit board 1, the connecting portion 253 of the metal member 25 fixed to the second end wall 24 abuts the inner edge of the notch 11*b*, thus limiting the circuit board 1 from being mated excessively with the first main body 22. Position limiting in multiple directions may be formed between the second end wall 24 and the notch 11*b*, and the structure between the second end wall 24 and the circuit board 1 is stable, ensuring proper electrical connections between the first terminals 21 and the second conductive portions 14 and the fourth conductive portions 16 on the circuit board 1. Thus, the first end wall 23 does not need to be engaged for position limiting with the circuit board 1. In this embodiment, the metal member 25 is not provided to cover the first top surface 231, and the first top surface 231 is flush with the mating bottom surface 281. Gaps 282 exists between the mating edge 114 and the first top surface 231 and between the mating edge 114 and the mating bottom surface 281, and the gaps 282 may facilitate ventilation and heat dissipation. Further, the mating edge 114 does not limit the position of the mating bottom surface 281, thus preventing the first connector 2 from limiting the position of the circuit board 1 in multiple locations and causing the circuit board 1 to be ill mounted, and reducing the manufacturing tolerances of the first end wall 23, the second end wall 24 and the mating slot 28.

As shown in FIG. 7 and FIG. 8, the metal member 25 fixed to the second end wall 24 is accommodated in the notch 11*b*, and the metal member 25 abuts the inner edge of the notch 11*b*, such that the structure between the first connector 2 and the circuit board 1 is stable. Further, the first top surface 231 is flush with the mating bottom surface 281, and the first portion 1141 of the mating edge 114 may be provided at its lowest location to directly abut the first top surface 231. That is, the side of the circuit board 1 close to the first end wall 23 has a larger space for the arrangement of the wires 12. Further, the horizontal sections 1212 of the first wires 121 on the circuit board 1 are basically straight lines from the first conductive portions 13 to the second conductive portions 14. On the premise that the lengths of the first wires 121 are shorter, and the third conductive portions 15 are located closer to the first end wall 23 relative to the first conductive portions 13, the larger space may allow the second wires 122 and the two conductive plates 123 connecting the third conductive portions 15 and the fourth conductive portions 16 to have less bending, which allows the lengths of the second wires 122 and the two conductive plates 123 to be provided shorter. Thus, the overall lengths of the wires 12 may be shortened, reducing the signal loss and improving the crosstalk, and facilitating high frequency characteristics of the electrical connector assembly 100. Other structures and functions of this embodiment are identical to those in the first embodiment, and thus are not further elaborated herein.

Figure 10:
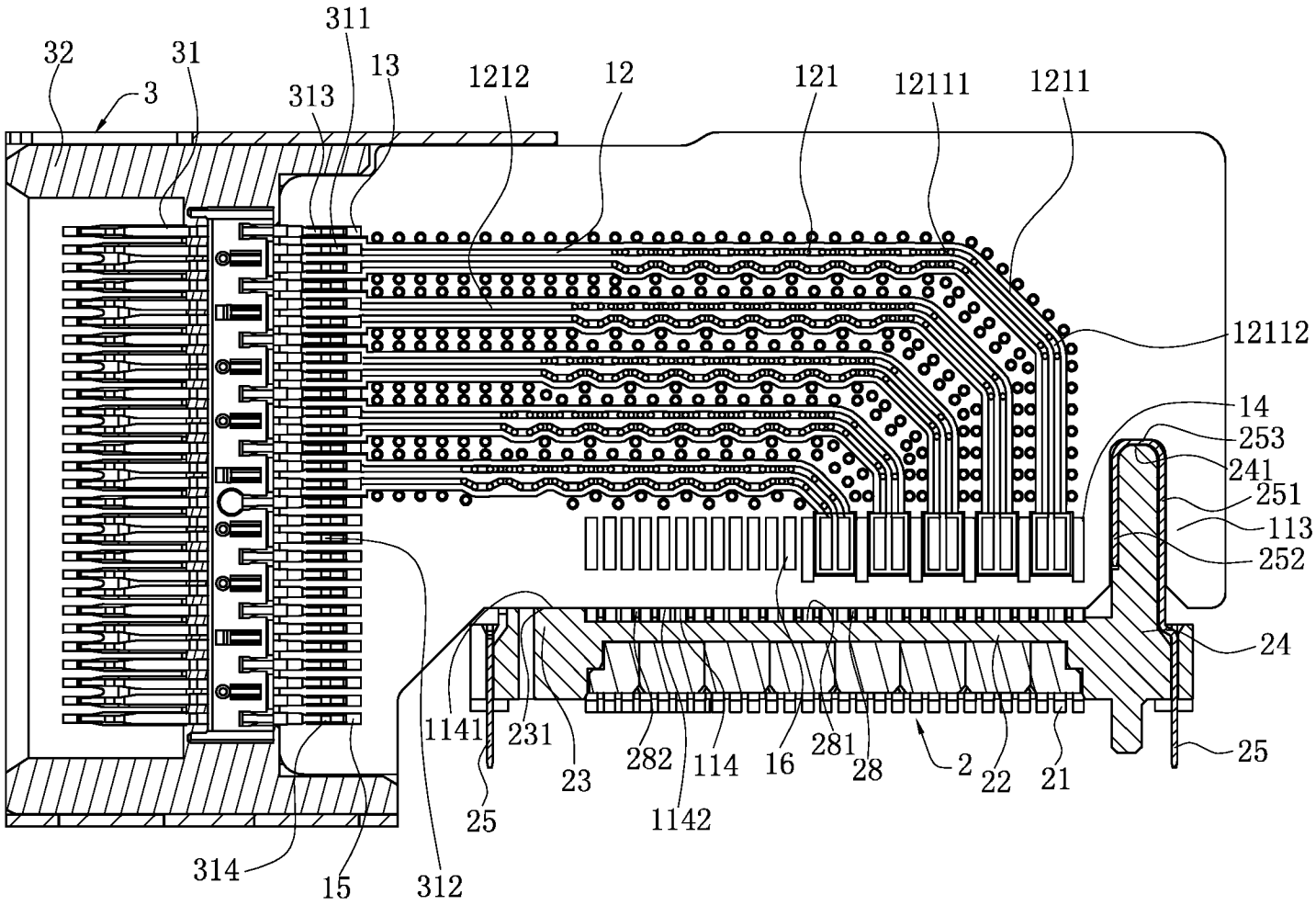
FIG. 10 is a schematic view of an electrical connector assembly according to a third embodiment of the present invention by removing the metal shell and a row of first terminals and sectioning the first main body and the second main body when the mating edge only abuts a top surface of the first end wall.

FIG. 10 shows an electrical connector assembly 100 according to a third embodiment of the present invention, which is different in that: the first portion 1141 and the second portion 1142 are coplanar, and the mating edge 114 is a continuous flat surface. In other embodiments, it is possible to provide the first portion 1141 and the second portion 1142 not to be coplanar, and to provide the mating edge 114 not as the continuous flat surface. The first top surface 231 is higher than the mating bottom surface 281, and the mating edge 114 only abuts the first top surface 231, thus limiting the circuit board 1 from being mated excessively with one side of the first end wall 23 of the first main body 22. In other embodiments, when the first top surface 231 is flush with the mating bottom surface 281, the mating edge 114 may simultaneously abut the first top surface 231 and the mating bottom surface 281. Alternatively, when the first top surface 231 is lower than the mating bottom surface 281, the mating edge 114 may only abut the mating bottom surface 281. In a mating direction for the mating slot 28 to mate with the circuit board 1, the first end wall 23 and the second end wall 24 both abut the circuit board 1, further ensuring the stable mating between the circuit board 1 and the first connector 2. Further, the metal member 25 fixed to the second end wall 24 may abut the inner edge of the notch 11*b* at one side of the circuit board 1 close to the second end wall 24, thus forming position limiting in multiple directions between the second end wall 24 and the notch 11*b*, and ensuring the stable mating between the second end wall 24 and the circuit board 1. Meanwhile, the first portion 1141 of the mating edge 114 may be provided at its lowest location to directly abut the first top surface 231. That is, the side of the circuit board 1 close to the first end wall 23 has a larger space for the arrangement of the wires 12, allowing the overall lengths of the wires 12 to be shortened, reducing the signal loss and improving the crosstalk, and facilitating high frequency characteristics of the electrical connector assembly 100. Other structures and functions of this embodiment are identical to those in the second embodiment, and thus are not further elaborated herein.

Figure 11:
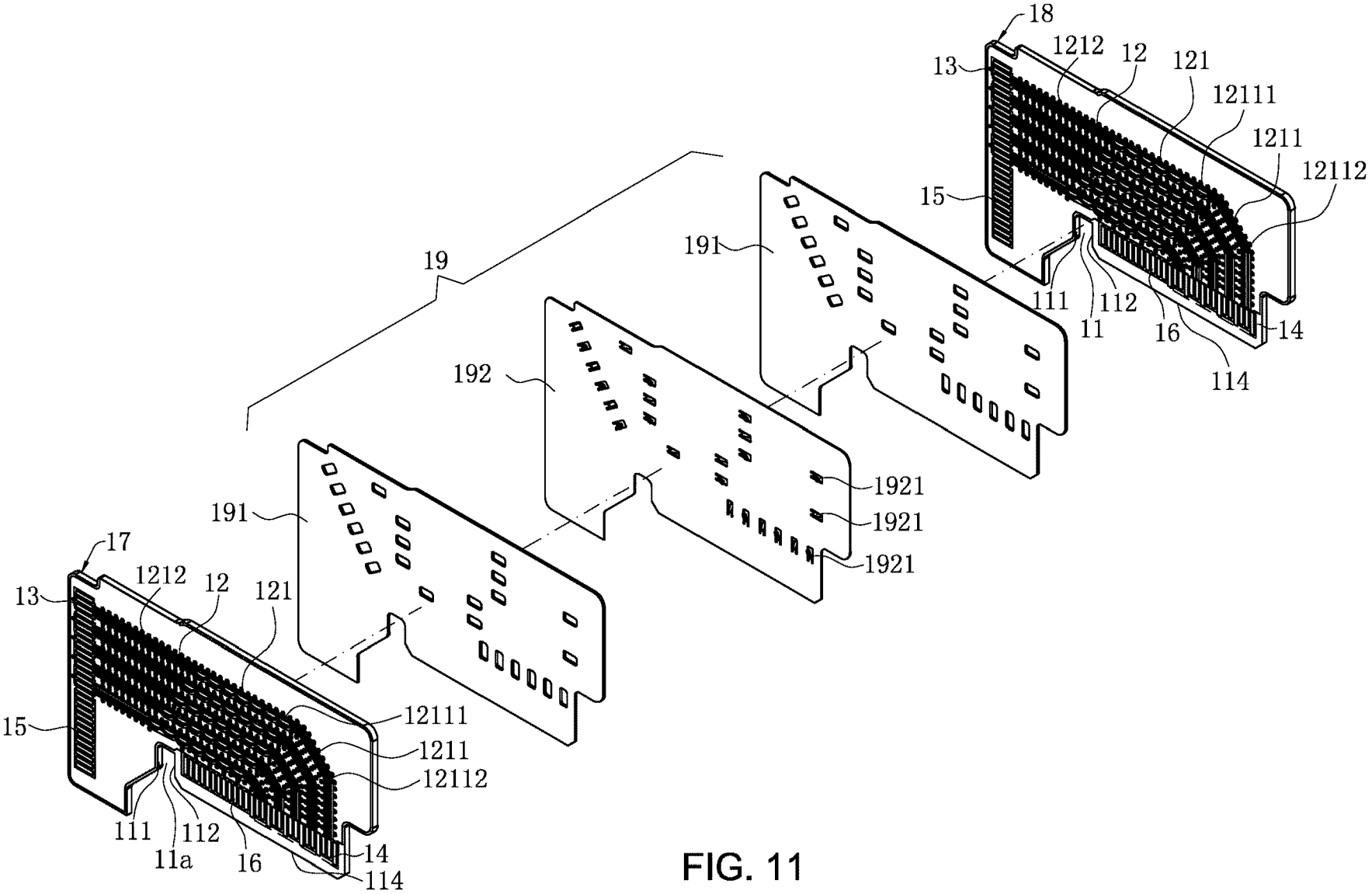
FIG. 11 is an exploded view of a circuit board of an electrical connector assembly according to a fourth embodiment of the present invention.

FIG. 11 shows an electrical connector assembly 100 according to a fourth embodiment of the present invention, which is different in that: the circuit board 1 includes a first circuit board 17, a second circuit board 18 and a connecting member 19 located between the first circuit board 17 and the second circuit board 18. The connecting member 19 includes two insulators 191 and a shielding member 192 located between the two insulators 191. The shielding member 192 is provided with a plurality of abutting sheets 1921, and the abutting sheets 1921 respectively pass through the insulators 191 to abut a grounding wire on the first circuit board 17 and a grounding wire on the second circuit board 18. Specifically, the shielding member 192 and the two insulators 191 are formed by injection molding. In other embodiments, they may be formed by assembly or by other forming methods. It is more difficult and with higher cost to manufacture a circuit board 1 having multiple layers of the wires 12 at once. Thus, by individually manufacturing the first circuit board 17 and the second circuit board 18 with fewer layers of the wires 12 in two pieces, and mechanically and electrically connecting the first circuit board 17 and the second circuit board 18 together by the connecting member 19 to form the circuit board 1 having multiple layers of the wires 12, the manufacturing difficulty is less and the cost is lower. It is possible to manufacture the circuit board 1 having more layers of the wires 12 using the method.

As shown in FIG. 11, the abutting sheets 1921 on the shielding member 192 respectively abut the grounding wire on the first circuit board 17 and the grounding wire on the second circuit board 18, thus shielding the crosstalk between the signal wire on the first circuit board 17 and the signal wire on the second circuit board 18, reducing the signal loss to the signal wire on the first circuit board 17 and the signal wire on the second circuit board 18, and facilitating stable transmission of the signals. The abutting sheets 1921 may be elastic sheets, fish eyes or other shapes formed by punching the shielding member 192. The abutting sheets 1921 may respectively abut the two opposite surfaces of the first circuit board 17 and the second circuit board 18, or may be inserted into the inner sides of the first circuit board 17 and the second circuit board 18, thus providing electrical connection while simultaneously supporting and fixing the first circuit board 17 and the second circuit board 18. The shielding member 192 may be formed by a copper foil, an iron sheet, or other metals with better electrical conductivity and shielding characteristics. The insulators 191 may prevent the two opposite surfaces of the first circuit board 17 and the second circuit board 18 from directly contacting the shielding member 192 and causing short-circuiting. Other structures and functions of this embodiment are identical to those in the first embodiment, and thus are not further elaborated herein.

In sum, the electrical connector assembly 100 according to certain embodiments of the present invention has the following beneficial effects:

1. Since the first top surface 231 of the first end wall 23 is lower than the corresponding first conductive portion 13 adjacent to the first end wall 23, a bottom surface of the notch 11*a* may be correspondingly lowered to be located lower than the corresponding first conductive portion 13 adjacent to the first end wall 23. Alternatively, the notch 11*a* is not even required, such that the first wires 121 have less bending from the first conductive portions 13 to the second conductive portions 14, thus reducing the overall length of each of the first wires 121, reducing the signal loss and improving the crosstalk, and facilitating high frequency characteristics of the electrical connector assembly 100.

2. The first wires 121 mainly transmitting high frequency signals are located at two opposite outermost layers of the circuit board 1. The first wires 121 has larger areas exposed in the air, and air has a smaller loss factor and a smaller dissipation factor (DF) value, which facilitates reducing the loss of the high frequency signals in the transmission process. The first wires 121 mainly transmitting high frequency signals are located at the two outermost layers of the circuit board 1 with a longer interval therebetween, and two central layers provided with the second wires 122 are provided between the two outermost layers provided with the first wires 121, thus reducing the signal crosstalk between the two outermost layers provided with the first wires 121, and facilitating enhancing the high frequency characteristics of the electrical connector assembly 100.

3. From the first end portion 12111 to the second end portion 12112, a straight line between the two points is the shortest path. Thus, the oblique section 1211 shortens the length of the corresponding first wire 121, and the average length of the first wires 121 is reduced, thus reducing the signal loss and crosstalk interference, and facilitating high frequency characteristics of the electrical connector assembly 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

a first connector, having a main body, wherein the main body has a first end wall and a second end wall opposite to each other, and a plurality of first terminals are provided on the main body;

wherein the first connector is configured to be mated with a circuit board, the circuit board has a plurality of first conductive portions, a plurality of second conductive portions and a plurality of first wires electrically connecting the first conductive portions and the second conductive portions correspondingly, the second conductive portions are correspondingly electrically connected to the first terminals, the first end wall is located closer to the first conductive portions relative to the second end wall, and a top surface of the first end wall is lower than a corresponding one of the first conductive portions adjacent to the first end wall.

2. The electrical connector assembly according to claim 1, wherein a metal member is fixed to the first end wall, a side of the circuit board close to the first end wall has a notch, the metal member is accommodated in the notch, and the metal member at least partially abuts an inner edge of the notch.

3. The electrical connector assembly according to claim 2, wherein:

the metal member has a first fixing portion and a second fixing portion provided opposite to each other, and a connecting portion connecting the first fixing portion and the second fixing portion;

the first fixing portion and the second fixing portion are respectively fixed to two side surfaces of the first end wall;

the connecting portion is fixed to the top surface of the first end wall; and the inner edge of the notch has a first surface and a second surface opposite to each other, and the second fixing portion abuts the second surface.

4. The electrical connector assembly according to claim 2, wherein the main body has two side walls connecting the first end wall and the second end wall and opposite to each other, the first end wall, the second end wall and the two side walls collectively define a mating slot to be mated with the circuit board, a top surface of the second end wall is higher than the top surface of the first end wall, and in a mating direction for the mating slot to mate with the circuit board, the metal member at least partially abuts the inner edge of the notch.

5. The electrical connector assembly according to claim 4, wherein:

the first connector has the first terminals respectively provided on the two side walls and exposed to the mating slot, and the first terminals comprise a plurality of first high speed signal terminals; and the circuit board has the second conductive portions respectively provided on two opposite surfaces of the circuit board, the first high speed signal terminals are correspondingly electrically connected to the second conductive portions, and the second end wall is located closer to the first high speed signal terminals relative to the first end wall.

6. The electrical connector assembly according to claim 1, wherein:

a metal member is fixed to the second end wall, a side of the circuit board close to the second end wall has a notch, the metal member is accommodated in the notch, and the metal member at least partially abuts an inner edge of the notch;

the main body has a mating slot to be mated with the circuit board, the circuit board has a mating edge, the mating slot has a mating bottom surface opposite to the mating edge, the top surface of the first end wall is defined as a first top surface, and the first top surface is flush with the mating bottom surface; and gaps exists between the mating edge and the mating bottom surface and between the first top surface and the mating bottom surface.

7. The electrical connector assembly according to claim 6, wherein:

the metal member has a first fixing portion and a second fixing portion provided opposite to each other, and a connecting portion connecting the first fixing portion and the second fixing portion;

the first fixing portion and the second fixing portion are respectively fixed to two side surfaces of the second end wall;

a top surface of the second end wall is defined as a second top surface, and the connecting portion is fixed to the second top surface; and a side of the notch away from the first end wall has a position limiting portion, and a side surface of the position limiting portion abuts the first fixing portion.

8. The electrical connector assembly according to claim 1, wherein a metal member is fixed to the second end wall, a side of the circuit board close to the second end wall has a notch, the metal member is accommodated in the notch, and the metal member at least partially abuts an inner edge of the notch;

the main body has a mating slot to be mated with the circuit board, the circuit board has a mating edge, the mating slot has a mating bottom surface opposite to the mating edge, the top surface of the first end wall is defined as a first top surface, the mating edge has a first portion and a second portion, the first portion is opposite to the first top surface, the second portion is opposite to the mating bottom surface, the first portion and the second portion are co-planar, and the mating edge is a continuous flat surface; and the first top surface is higher than the mating bottom surface, and the mating edge only abuts the first top surface.

9. The electrical connector assembly according to claim 1, wherein:

the circuit board further has a plurality of third conductive portions and a plurality of fourth conductive portions, the third conductive portions and the first conductive portions are arranged on a same first straight line, the fourth conductive portions and the second conductive portions are arranged on a same second straight line, and the first straight line and the second straight line are not collinear;

the first connector has the first terminals, comprising a plurality of first high speed signal terminals and a plurality of first low speed signal terminals, the first high speed signal terminals are correspondingly electrically connected to the second conductive portions, and the first low speed signal terminals are correspondingly electrically connected to the fourth conductive portions; and a second connector is provided with a plurality of second terminals, comprising a plurality of second high speed signal terminals and a plurality of second low speed signal terminals, the second high speed signal terminals are correspondingly electrically connected to the first conductive portions, and the second low speed signal terminals are correspondingly electrically connected to the third conductive portions.

10. The electrical connector assembly according to claim 9, wherein the circuit board has a plurality of wires provided in at least four layers, the wires comprise the first wires symmetrically located in two opposite outermost layers of the at least four layers of the circuit board and a plurality of second wires symmetrically located in two central layers of the at least four layers of the circuit board, the first wires correspondingly connect the first conductive portions and the second conductive portions, and the fourth conductive portions correspondingly electrically connected to the first low speed signal terminals and the third conductive portions correspondingly electrically connected to the second low speed signal terminals are electrically connected by the second wires.

11. The electrical connector assembly according to claim 10, wherein the third conductive portions are located below the first conductive portions, and when the second conductive portions are correspondingly electrically connected to the first terminals, a bottom surface of the main body is higher than or flush with at least one of the third conductive portions.

12. The electrical connector assembly according to claim 1, wherein a second connector is provided with a plurality of second terminals, the first conductive portions are correspondingly electrically connected to the second terminals, the second connector has a metal shell, the metal shell covers the first end wall, the metal shell has two mounting portions respectively located at two opposite sides of the main body and flush with a bottom surface of the main body, and the two mounting portions and the main body are mounted on a same substrate.

13. The electrical connector assembly according to claim 1, wherein:

an arranging direction of the first conductive portions and an arranging direction of the second conductive portions are perpendicular to each other;

the circuit board has the first wires, each of the first wires has a horizontal section and an oblique section connected to each other, the horizontal section and a corresponding one of the first conductive portions are located on a same straight line, and the horizontal section is parallel to the arranging direction of the second conductive portions; and the oblique section is a straight line structure, the oblique sections of the first wires form a plurality of straight lines parallel to one another, each of the oblique sections of the first wires has a first end portion and a second end portion, the second end portion is located closer to a corresponding one of the second conductive portions relative to the first end portion, the first end portion is connected to the horizontal section, the second end portion and the corresponding one of the first conductive portions are located on a same straight line, and the second end portion is located above the corresponding one of the second conductive portions.

14. The electrical connector assembly according to claim 13, wherein:

the circuit board further has a plurality of third conductive portions and a plurality of fourth conductive portions, the fourth conductive portions are located closer to the third conductive portions relative to the second conductive portions;

the first connector has the first terminals, comprising a plurality of first power terminals, and the first power terminals are correspondingly electrically connected to the fourth conductive portions;

a second connector is provided with a plurality of second terminals, comprising a plurality of second power terminals, and the second power terminals are correspondingly electrically connected to the second conductive portions; and the fourth conductive portions correspondingly electrically connected to the first power terminals and the second conductive portions correspondingly electrically connected to the second power terminals are electrically connected to each other by at least one conductive plate.

15. The electrical connector assembly according to claim 1, wherein the circuit board comprises a first circuit board, a second circuit board and a connecting member located between the first circuit board and the second circuit board, the connecting member comprises two insulators and a shielding member located between the two insulators, the shielding member is provided with at least two abutting sheets, and the at least two abutting sheets respectively pass through the insulators to abut a grounding wire on the first circuit board and a grounding wire on the second circuit board.

* * * * *